US005269535A

United States Patent [19]

Gagné

[11] Patent Number: 5,269,535

[45] Date of Patent: Dec. 14, 1993

[54] ARROWHEAD CARTRIDGE FOR OBSTRUCTING THE DIRECTION OF TRAVEL OF GAME ANIMALS

[76] Inventor: Albert Gagné, 185 McVicar, Brownsburg, Quebec, Canada, J0V 1A0

[21] Appl. No.: 826,969

[22] Filed: Jan. 28, 1992

[51] Int. Cl.[5] ..... F42B 6/08

[52] U.S. Cl. ..... 273/420; 273/418

[58] Field of Search ..... 273/416, 418, 419, 420, 273/421

[56] References Cited

U.S. PATENT DOCUMENTS

| | | | |
|---|---|---|---|
| 600,772 | 3/1898 | Ettinger | 273/420 X |
| 1,328,967 | 1/1920 | Reaben | 273/419 |
| 1,669,118 | 5/1928 | Betts | 273/419 |
| 2,873,973 | 2/1959 | Hauch | 273/421 |
| 2,904,338 | 9/1959 | Podufal | 273/419 |
| 2,940,759 | 6/1960 | West | 273/420 |
| 3,066,940 | 12/1962 | De Lonais | 273/418 |
| 4,729,320 | 3/1988 | Whitten, III | 273/418 X |
| 4,951,952 | 8/1990 | Saddler | 273/416 |
| 5,035,435 | 7/1991 | Burgeson et al. | 273/418 |
| 5,123,657 | 6/1992 | Colt et al. | 273/419 X |

OTHER PUBLICATIONS

Gander Mountain, Inc. Outdoor Sportsman Supplies Catalog, Mar. 1987, p. 76, Scent Shuttle.

*Primary Examiner*—Paul E. Shapiro

[57] ABSTRACT

An arrowhead cartridge for generating a sound upon impact for detection by an animal, whereby to redirect the path of travel of the animal. The cartridge has a housing secured to a forward end of an arrow shaft with one or more openings therein. The housing has a blunt forward end and a chamber therein associated with a displaceable element to trigger a sound generating element located in the chamber. The displaceable element is a cylindrical wall section of the housing secured for axial displacement with the shaft of an arrow and upon an impact force applied to the blunt forward end of the housing and actuates the triggering element. The triggering element is prevented from being actuated by the thrust force of a bow by a restraining element when projecting the arrow. The restraining element releases when the blunt forward end strikes an arresting medium.

2 Claims, 2 Drawing Sheets

ARROWHEAD CARTRIDGE FOR OBSTRUCTING THE DIRECTION OF TRAVEL OF GAME ANIMALS

BACKGROUND OF INVENTION

1. Field of the Invention

The present invention relates to an arrowhead cartridge for generating a sound or scent upon impact so that the scent or sound is detectable by an animal whereby to redirect the path of travel of the animal.

2. Description of Prior Art

It is known to provide arrowheads with all cartridges whereby to provide an arrowhead having a high impact shock so that a game animal can be killed as quickly as possible. Such an arrowhead equipped with a cartridge is disclosed in U.S. Pat. No. 4,762,328 issued on Aug. 9, 1988.

SUMMARY OF INVENTION

The present invention relates to a cartridge to fit on the forward end of an arrow but having a different structure and for different use and, particularly, for the generation of sound or scent upon impact whereby a game animal that is detected out of range by a bow hunter can be redirect the animal in his direction. The hunter fires arrows equipped with these cartridges forwardly of the direction of travel of the animal so that the animal will be discouraged from travelling in a specific direction and be redirected.

It is therefore a feature of the present invention to provide an arrowhead cartridge for generating a sound or scent upon impact so that the sound or scent is detected by the animal to redirect the path of travel of the animal.

Another feature of the present invention is to provide an arrowhead cartridge which is easy to install on the forward tip of an arrow shaft and which is safe to use.

According to the above features, from a broad aspect, the present invention provides an arrowhead cartridge for generating a sound or scent upon impact for detection by a game animal whereby to redirect the path of travel of the animal. The cartridge comprises a housing securable to a forward end of an arrow shaft. The housing has a chamber with which is associated a displaceable element to trigger a sound or scent generation means in communication with the chamber. The displaceable element is secured for axial displacement with the shaft of an arrow and upon an impact force applied to a forward end of the housing. Restrainment means is provided to prevent the displaceable element to be actuated by the thrust force generated by a bow in projecting an arrow fitted with the cartridge.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
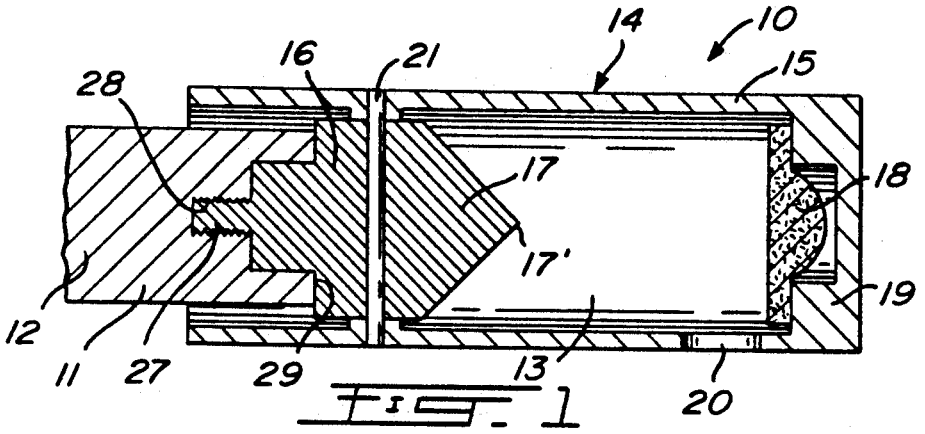
FIG. 1 is a cross-section, partly fragmented view, showing the construction of an arrowhead cartridge of the present invention as secured to the tip of an arrow shaft.

Referring to the drawings, and more particularly to FIGS. 1 to 4, there is shown generally at 10, the arrowhead cartridge of the present invention as secured to the forward end 11 of the shaft of an arrow 12. The cartridge 10 is comprised of a housing 14 defining a chamber 13 therein. As herein shown, the housing has an axially displaceable cylindrical wall section 15 which is disposed in sliding fit over a stationary housing section 16. A triggering element 17 is shown in FIG. 1 as forming part of the stationary housing and has a triggering point 17' extending inwardly of the chamber 13. A sound generating explosive pellet 18 is mounted, by suitable securement means such as glue, to a front wall 19 of the housing 14 and in alignment with the triggering point 17'.

The cylindrical displaceable wall section 15 is also provided with an opening 20, herein adjacent the explosive pellet 18, whereby to permit sound to escape from the chamber 13 when the explosive pellet 18 is detonated by the triggering point 17' and upon the front wall 19 of the housing being subjected to an impact force when the arrow is projected against a surface. Restrainment means in the form of a locking pin 21 secures the cylindrical displaceable wall section 15 to the stationary housing section 16 and breaks upon an impact force being applied to the front wall 19 of the housing 14. However, this locking pin 21 has sufficient strength to resist the thrust force imparted on the arrow 12 by a bow utilized in projecting the arrow fitted with the cartridge 10.

The explosive pellet 18 is one which is not harmful and may, for example, consist of a pellet having a weight of 0.2 grams and formed from a chemical composition consisting of potassium chlorate, red phosphorus, manganese dioxide, magnesium oxide, sand and glue, as is well known in the art.

Figure 2:
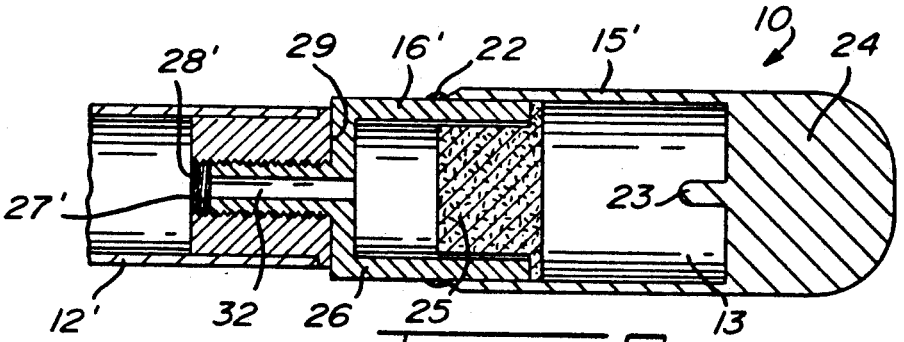
FIG. 2 is a view similar to FIG. 1 but showing another variant of the arrowhead cartridge.
Figure 3:
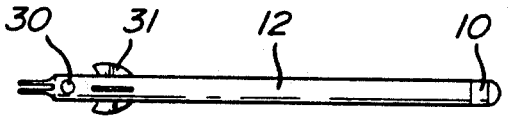
FIG. 3 is a side view of an arrow having an arrowhead cartridge of the present invention as secured to the forward tip thereof.

As shown in FIG. 2, the restraining means is herein shown as consisting of glue spots 22 securing the cylindrical displaceable wall section 15' to the stationary housing section 16'. As also herein shown, the triggering element 23 is mounted in the front wall 24 and projects inwardly of the chamber 13 towards the explosive pellet 25 which is secured about a cup-shaped hollow stationary housing section 26. The stationary housing section 16 and 16' is provided with a connecting pin, herein a threaded pin 27 and 27', for removable securement in a securement bore 28 and 28' respectively provided in the forward end 29 of the arrow shaft. The shaft 12' of FIG. 2 is a hollow shaft and has an opening 30 provided at a rear end thereof behind the stabilizing fins 31 of the arrow 12 so that the sound emanated by the detonation of the explosive pellet 25 will be transmitted through the conduit 32 provided in the connecting pin 27' and through the hollow shaft 12' and out through the opening 30 with the front end or cartridge 10 of the arrow 12 being implanted in a ground surface or in any other surface.

Figure 4:
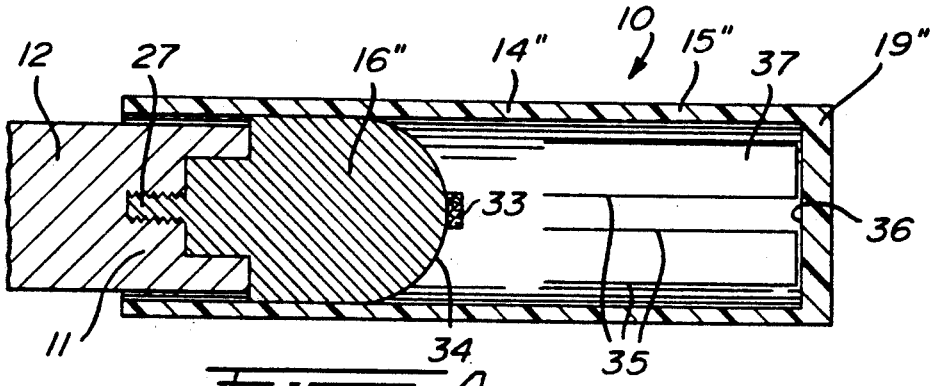
FIG. 4 is a section view, similar to FIGS. 1 and 2, and showing a still further variant of the arrowhead cartridge of the present invention.

As shown in FIG. 4, the explosive pellet 33 is herein mounted on a forward spherical end 34 of the stationary housing section 16" with the cylindrical displaceable housing wall section 15" being secured to the stationary housing section 16" by friction contact only. The housing 14" is herein formed of a flexible or deformable material, such as plastics, and has U-shaped slits 35 formed in a forward section of the displaceable wall section 15" so that when the cartridge 33 is urged against the inner surface 36 of the front wall 19", the impact force of the explosion of the cartridge will cause the wall sections 37 within the slits 35 to flex outwardly to release pressure and sound.

Figure 5:
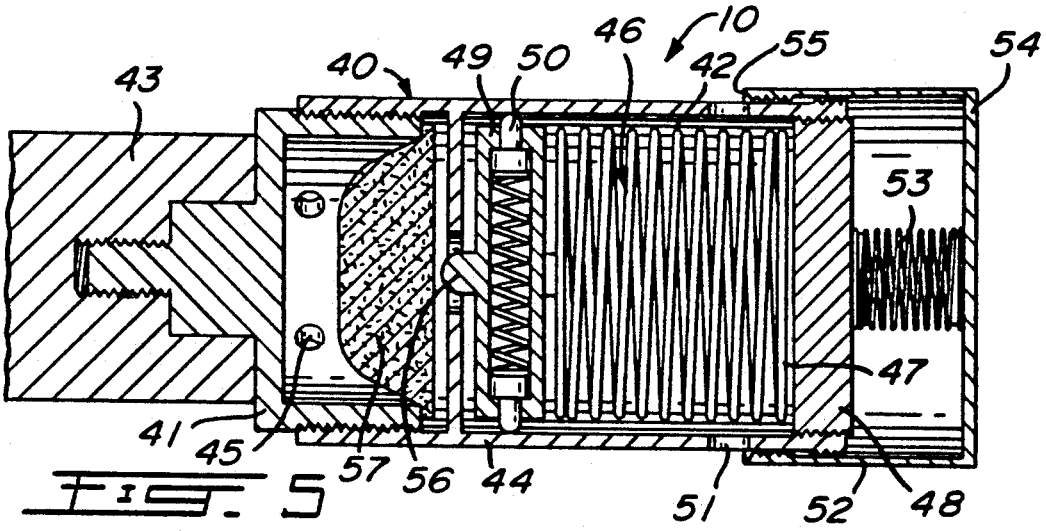
FIG. 5 is a section view, also similar to FIGS. 1 and 2, but showing a still further variant of the arrowhead cartridge of the present invention.
Figure 6:
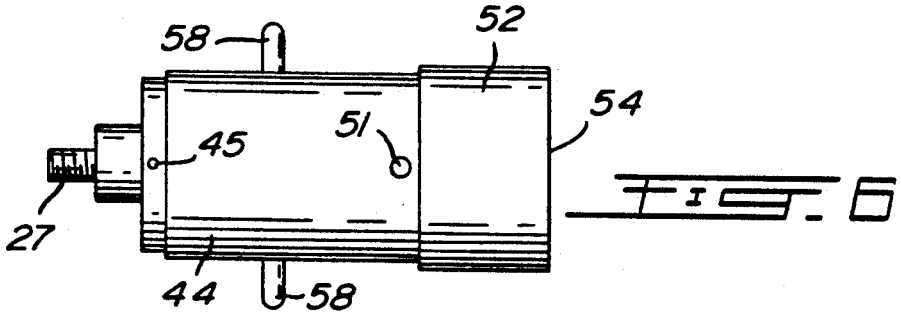
FIG. 6 is a side view of the cartridge of FIG. 5.

Referring now to FIGS. 5 and 6, there is shown a still further embodiment of the arrowhead cartridge 10 of the present invention. As herein shown, the housing 40 is comprised of a stationary housing section 41 secured to the arrow shaft 43 in a similar manner as previously described and has an outer cylindrical housing section 44 in threaded engagement with the stationary section 41. Holes 45 are provided in the cylindrical housing section 44 for the escapement of sound or a scent produced inside the housing 40.

Inside the housing chamber 42, there is secured a spring actuated mechanism 46 which is comprised of a coil spring 47 compressed about a stationary bottom wall 48 by a displaceable front wall 49 having a release means in the form of spring loaded pins 50 secured therein. By pushing the displaceable front wall 49 against the coil spring 47, it is compressed against the back wall 48 with the pins 50 being urged in the pin receiving holes 51 so as to retain the coil spring in a compressed form. A displaceable cylindrical wall section 52 is positioned about the cylindrical housing section 44 in a front end thereof and is slideable over this wall a predetermined distance. The displaceable cylindrical wall 52 is biased outwardly by a coil spring 53 interposed between the back wall 48 of the cylindrical housing section 44 and the front wall 54 of the displaceable cylindrical wall 52. The edge of this displaceable cylindrical wall 52 is sloped at 55 in at least the area of the openings 51 whereby to abut against the spherical head of the pin 50 extending therethrough to push the pins inwardly of the holes to release the coil spring 47 and urge the front wall 49 forwardly. As herein shown, a firing pin 56 is provided in the front wall 49 and upon being urged forwardly, contacts the explosive pellet 57 and detonates its charge. The sound from this explosion is released through the openings 45 in the stationary housing section 41.

As shown in FIG. 6, the cylindrical wall 44 may also be provided with longitudinal slits (not shown) and through finger grasping prongs 58 can project whereby to facilitate the loading of the coil spring 47. By pushing the prongs 58 towards the displaceable cylindrical housing 52, the front wall 49 is pushed rearwardly until the pins 50 locate in the holes 51. This would permit the coil spring to be loaded only prior to use of an arrow equipped with the cartridge 10.

Figure 7:
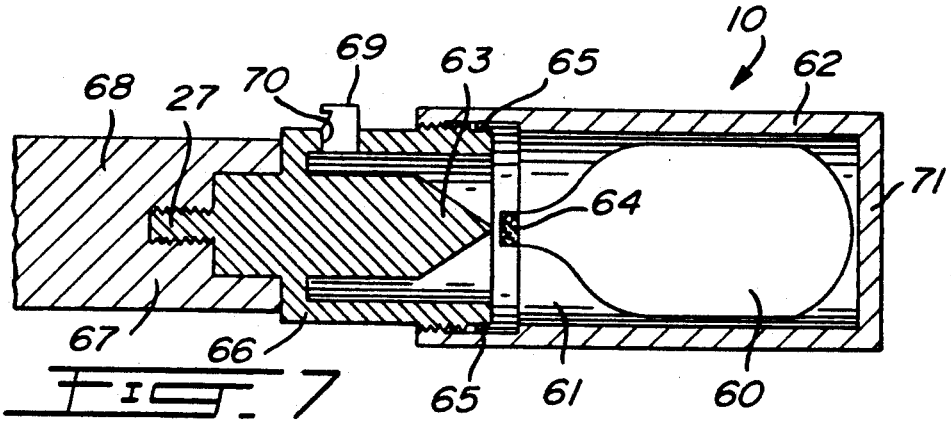
FIG. 7 is a section view, similar to FIGS. 1 and 2, showing a still further variant of the arrowhead cartridge of the present invention.
Figure 8:
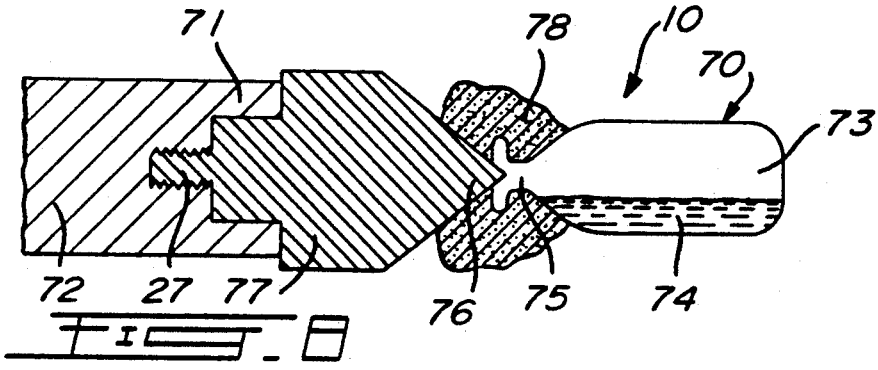
FIG. 8 is a still further section view, similar to FIGS. 1 and 2, and showing a still further variant.

Referring now to FIGS. 7 and 8, there are shown still further modifications of the arrowhead cartridge. As shown in FIG. 7, a compressed air bottle or reservoir 60 is mounted within the chamber 61 inside the displaceable cylindrical wall section 62. A triggering pointed element 63 is aligned with an actuating end 64 of the reservoir 60 whereby to release compressed air from within the reservoir and into the chamber 61. An O-ring seal 65 seals the displaceable cylindrical housing section 62 with the stationary housing section 66 secured to the outer end 67 of the arrow shaft 68. A whistle 69 is secured within a hole 70 provided in the stationary housing section 66 and communicates with the chamber 61. Accordingly, the out of the chamber through the whistle 69 and emanate a sound.

It is also pointed out that it may not be necessary to provide a compressed air reservoir within the chamber 61 and that merely the displacement of the displaceable cylindrical housing section 62 would be sufficient to compress air when the front wall 71 thereof impacts upon a surface whereby the compressed air will flow out through the whistle and emanate a sound.

FIG. 8 shows a still further embodiment wherein the housing 70 secured to the forward end 71 of the arrow shaft 72 is constituted by a bottle 73 having a scented liquid 74 therein. The open end 75 of the bottle 73 is mounted about a pointed end 76 of a stationary cone 77 removably secured in the end 71 of the arrow shaft 72. The bottle is secured to the cone by an adhesive material 78 which hardens and seals the bottle opening about the cone. When the arrow is projected and the head impacts upon an object, the bottle 73 will fragment thereby releasing the scent solution 74 contained therein. This scent solution will be detected by the animal and cause it to move in a different direction.

It is within the ambit of the present invention to cover any obvious modifications of the preferred embodiments described herein provided such modifications fall within the scope of the appended claims.

I claim:

1. An arrowhead cartridge for generating a sound upon impact for detection by a game animal to redirect the path of travel of the animal, said cartridge comprising a housing formed of flexible material and securable to a forward end of an arrow shaft, said housing having one or more slit panels formed in a side wall thereof for transmission of said sound, said housing further having a chamber with which is associated a displaceable element to trigger a sound generation means in communication with said chamber, said displaceable element being secured for axial displacement with said shaft of an arrow and upon an impact force generated by said forward end of said housing, and restrainment means having sufficient resistance to prevent said displaceable element to be actuated by the thrust force generated by a bow in projecting an arrow fitted with said cartridge, said restraining means releasing upon said housing being subjected to said impact force to permit said displaceable element to trigger said sound, said displaceable element being an axially displaceable cylindrical wall housing section disposed in sliding fit with a stationary housing section, and a triggering element inside said chamber to trigger said sound generating means upon a predetermined axial displacement of said displaceable cylindrical wall by said impact force.

2. An arrowhead cartridge as claimed in claim 1 wherein said sound generating means is an explosive pellet mounted inside said housing in alignment with said triggering element, said pellet being exploded when contacted by said triggering element upon displacement of said displaceable cylindrical wall by said impact force.

* * * * *